United States Patent [19]

Bogdanovs

[11] Patent Number: 4,924,365

[45] Date of Patent: May 8, 1990

[54] ADJUSTABLE REFLECTOR ATTACHMENT

[75] Inventor: Andris Bogdanovs, Liverpool, N.Y.

[73] Assignee: Cooper Industries, Inc., Houston, Tex.

[21] Appl. No.: 324,946

[22] Filed: Mar. 17, 1989

[51] Int. Cl.[5] ..... F21S 3/00

[52] U.S. Cl. ..... 362/224; 362/225; 362/282

[58] Field of Search ..... 362/217, 223, 224, 225, 362/277, 282, 222

[56] References Cited

U.S. PATENT DOCUMENTS 4,598,344 7/1986 Nadler ..... 362/282

*Primary Examiner*—Carroll B. Dority

*Attorney, Agent, or Firm*—David A. Rose; Donald Verplancken

[57] ABSTRACT

A lighting fixture has parabolic, asymmetric, adjustable reflectors longitudinally disposed in alignment with the lamps therein. The reflector is attached to the lighting fixture by a fastener and dimpled end plate. Dimpled end plate mounts to the end of reflector, which includes a recessed plate thereon having matching recesses for receiving the dimples. By rotating end plate and reflector with respect to the recessed plate, the orientation of the reflector may be circumferentially varied.

16 Claims, 4 Drawing Sheets

ADJUSTABLE REFLECTOR ATTACHMENT

This invention relates to fluorescent lighting fixtures in general and more particularly to reflectors for lighting fixtures having asymmetric profile with reversible end plates.

BACKGROUND OF THE INVENTION

Explosion-proof lighting fixtures are used in applications where there is a possibility that internal arching may cause explosions which would otherwise propagate to an external explosive atmosphere. These explosion-proof lighting fixtures are constructed to exacting standards and are usually heavy duty and in fixed immobile locations. Because it is sometimes necessary to direct the light in a different direction, reflectors have been incorporated in these lights.

SUMMARY OF THE INVENTION

The present invention incorporates asymmetric parabolic reflectors that may be adjusted to direct light in different directions. The adjustment of the reflector is accomplished by loosening one screw axially mounted in the approximate center of the end plate of the reflector, so that a dimple locating means can be repositioned on the circumference of the tube around the lamps. In two light applications the reflector end plate is manufactured with symmetric dimples so that one extrusion can be used in a reverse position on both the right and left hand lamp tube.

BRIEF DESCRIPTION OF THE FIGURES

FIG. 4D is a detail view of a portion of the lamp tube assembly end cap shown in FIG. 4C.

DETAILED DESCRIPTION OF THE DRAWINGS

Figure 1:
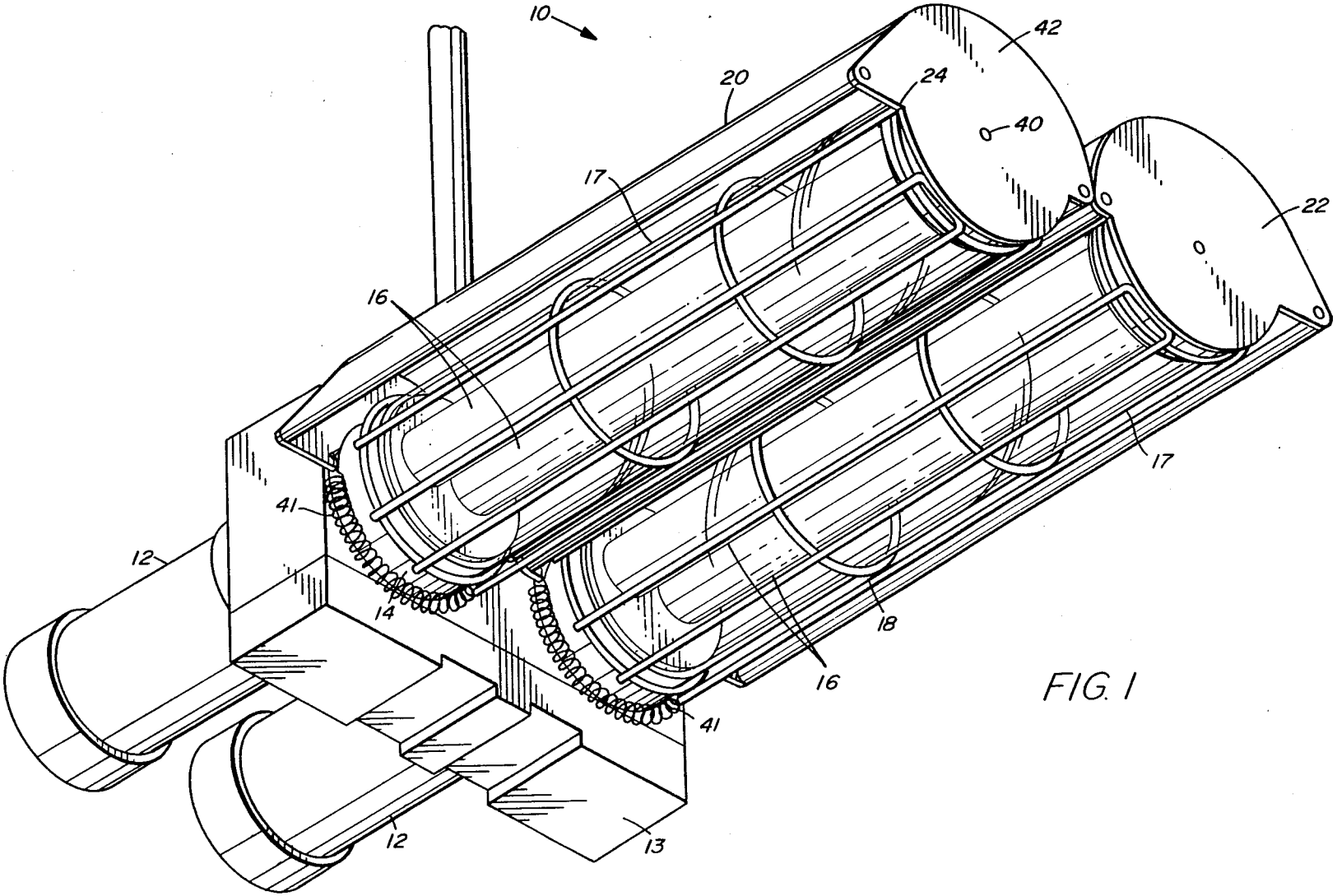
FIG. 1 is a perspective view of an explosion-proof fluorescent light according to the present invention.

Referring to FIG. 1, an explosion-proof fluorescent lighting fixture 10 is shown. The main components of explosion-proof fixture 10 are ballast housing 12, main housing 13, and lamp holders 14. A glass tube 17, is mounted over lamp holder 14 into housing 13 and contains fluorescent lamps 16. In this embodiment each glass tube 17 encloses two fluorescent lamps 16. Reflector 20 is mounted so that it directs fluorescent light as will be discussed in more detail below.

Figure 3:
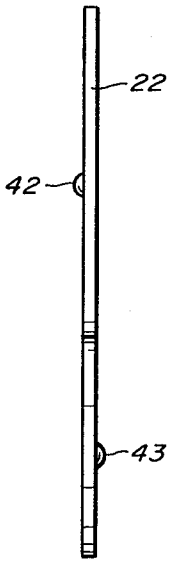
FIG. 3 is a side view of the end plate shown in FIG. 2.
Figure 2:
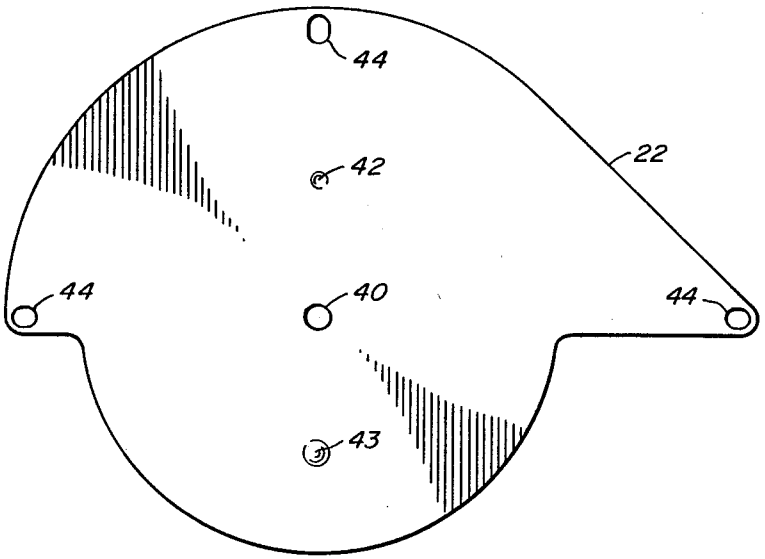
FIG. 2 is a front view of the end plate of the explosion-proof light shown in FIG. 1.

End plate 22 is attached to the end of reflector 20 and attached by screw 40 to lamp tube assembly end cap 24. As show in more detail in FIG. 2, end plate 22 has a screw 40 at the center of the end plate. There are two dimples or projections 42 and 43 located 180° apart. The dimples are coined in a metal end plate such that dimple 42 would be protruding out of the paper and dimple 43 protruding into the paper. This is shown more clearly in FIG. 3, which is a side view of end plate 22 shown in FIG. 2. End plate 22 is attached to reflector 20 by reflector screws 44.

Figure 4C:
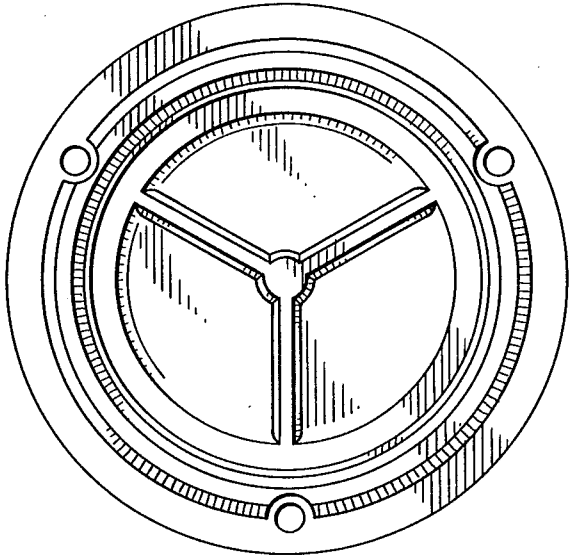
FIG. 4C is a rear view of the lamp tube assembly end cap of FIG. 4A.
Figure 4B:
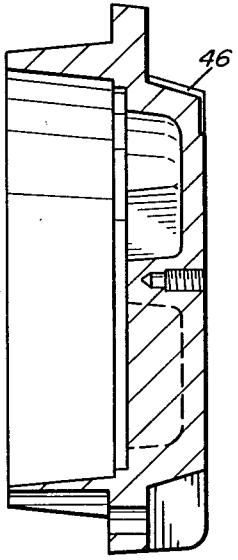
FIG. 4B is a cross sectional view of the lamp tube assembly end cap of FIG. 4A at section 4—4.
Figure 4A:
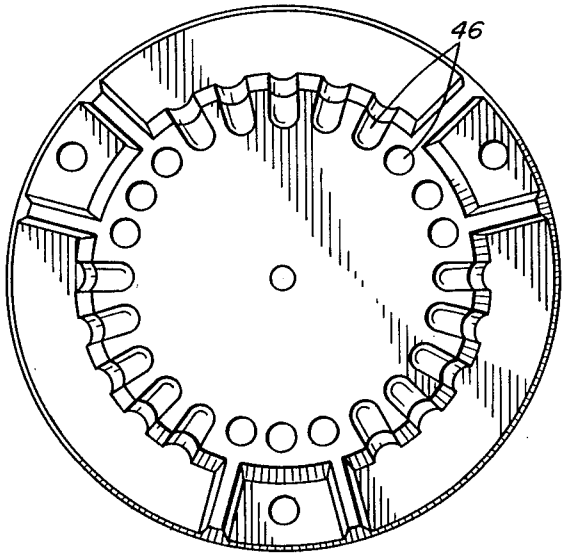
FIG. 4A is a front view of the lamp tube assembly end cap with the end plate removed.
Figure 6:
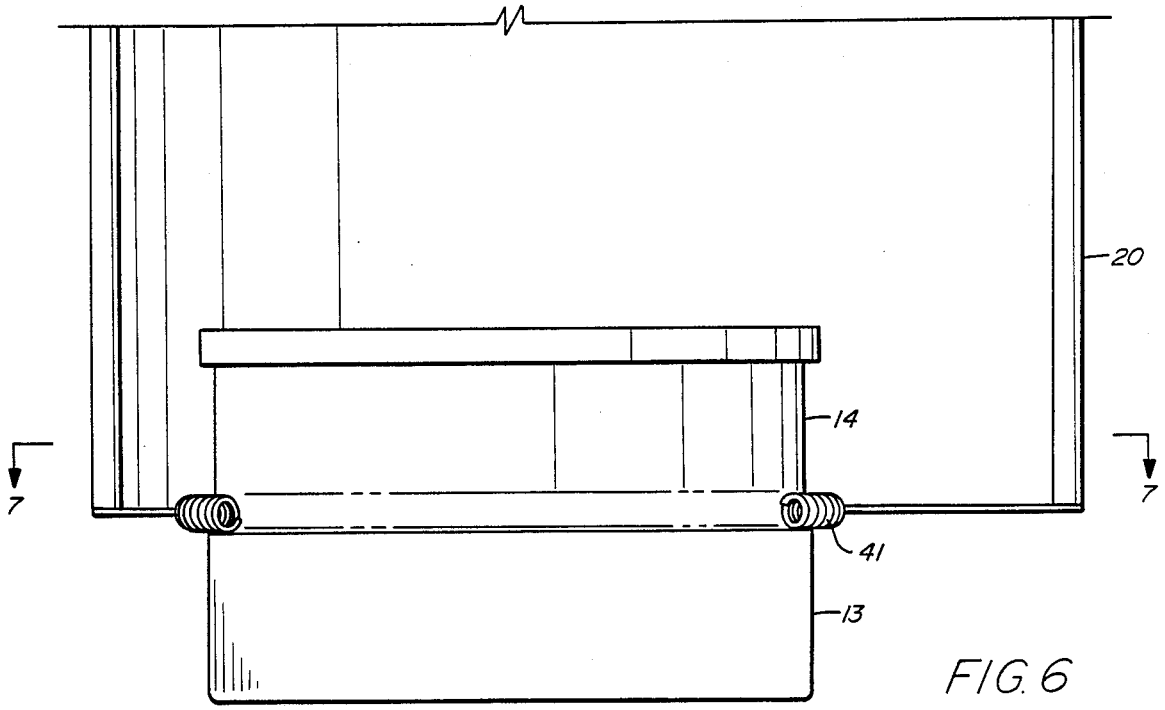
FIG. 6 is a partial bottom view of the fluorescent light fixture of FIG. 1.
Figure 7:
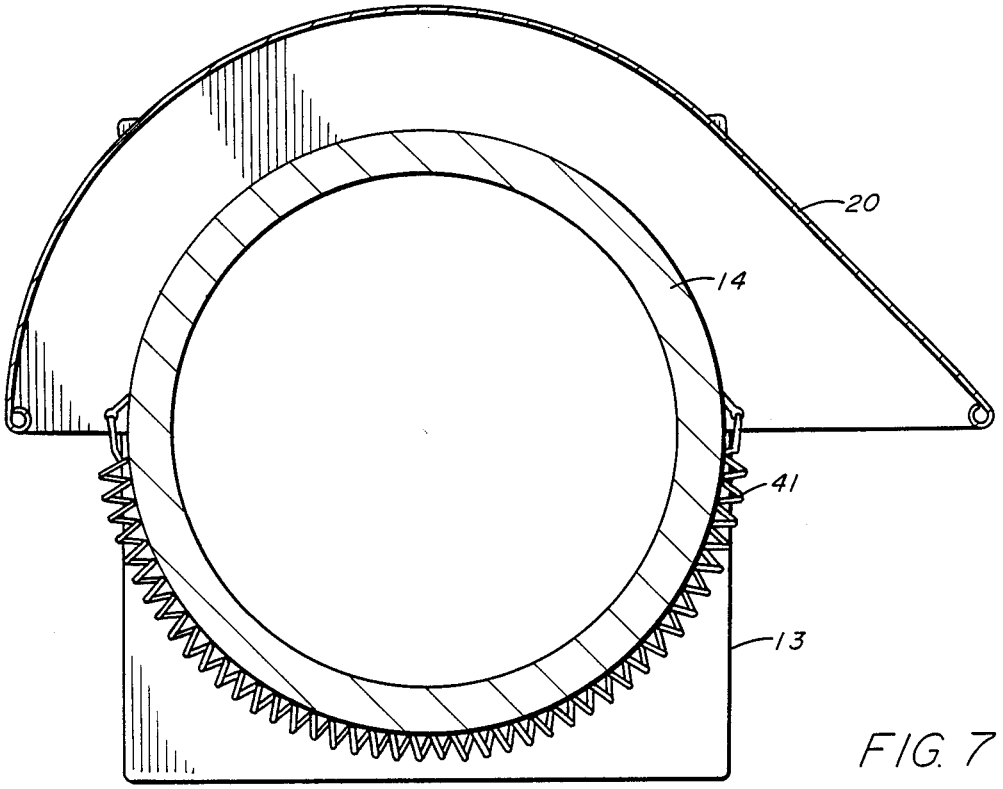
FIG. 7 is a sectional view of the fluorescent light at section 7—7 of FIG. 6.

FIG. 4A which is a front view of the lamp tube assembly end cap 24 with end plate removed. Cavities 46 are easily seen. These are indentations in end cap 24 and easily fit indented dimple 42.

In operation to change end point of the light, screw 40 would be loosened approximately one-half turn so that dimple 42 could ride up out of cavity 46 and the reflector could be rotated either clockwise or counter clockwise to change the aim point of the light. The screw would then be retightened, forcing dimple 42 into a different cavity 46.

A spring 41 is mounted on the end of the reflector 20 opposite screw 44. The spring holds the reflector to the lighting fixture 10 an allows the reflector 20 to be rotated about fixture 10.

Although the cavities 46 in end plate 24 are shown equally spaced around the circumference at 15° intervals, it will be readily appreciated that different spacings could be provided for.

End plate 22 is manufactured so that right and left end plates are made from the same stamping or coining process. It will be noted that dimple 42 which is pointing out of FIG. 2 and does not engage cavities 46, and dimple 43 which does engage cavities 46 and would be used on the right hand fixture in FIG. 1, if reversed 180°, end plate 22 could be used on the left hand fixture in FIG. 1 and dimple 42 would be pointed inward and engage cavities 46. Thus it is seen that end plates of asymmetrical design can be made in one stamping process and used for both right and left hand fixtures minimizing manufacturing cost.

Figure 5B:
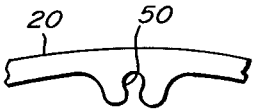
FIG. 5B is a detailed view of a portion of the reflector shown in FIG. 5A.
Figure 5A:
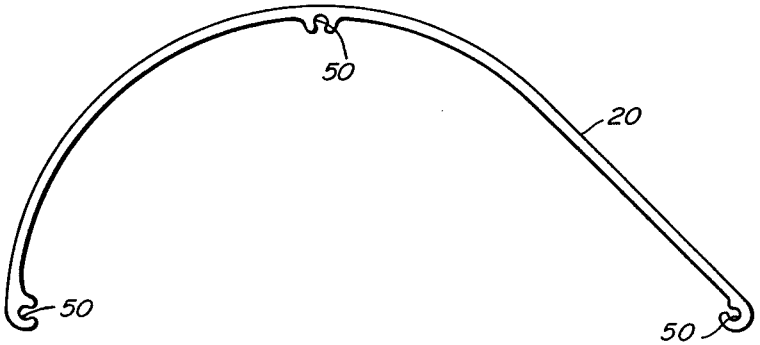
FIG. 5A is an end view of the reflector shown in FIG. 1.

In a like manner reflector 20 shown in FIG. 5 is asymmetric in shape. It is made from an aluminum extrusion with screw mounts 50 running the length of the reflector. The reflector is also manufactured in such a manner that it can be used either for the right or left hand reflector shown in FIG. 1 by simply reversing the orientation of the reflector front to back. Thus it is seen that even though the reflector is asymmetric, one extrusion process can be used to manufacture both right hand and left hand reflector.

I claim:

1. A lighting fixture comprising:

a housing;

a lamp holder projecting from said housing;

a reflector mounted on said lamp holder by means of a spring;

a dimple in said reflector;

a glass tube projecting from said lamp holder;

an end cap mounted on said glass tube opposite said lamp holder;

cavities in said end cap which selectively engage said dimple;

a fastener in said reflector and end cap which may be loosened to allow rotation of the reflector relative to said end cap to engage said dimple of said reflector into a cavity of said end cap for desired positioning and subsequent retightening without any disassembly of parts.

2. A lighting fixture as in claim 1 wherein said spring is attached to said reflector and wrapped around a cylindrical portion of said lamp holder to allow said reflector to be rotated.

3. A lighting fixture comprising;
one or more lamp holders;
one or more lamps;
a glass tube or set of tubes enclosing said lamps;
an end cap on each of said tubes;
a reflector;
a spring attached to one end of said reflector and which wraps around a portion of said lamp holder; and
an end plate attached to said end cap by a fastener located at the approximate center of said end plate, and having a dimple which interacts with cavities in said end cap.

4. A lighting fixture as in claim 3 wherein said end plate has two dimples located approximately 180°, one oriented inward and one oriented outward.

5. A lighting fixture as in claim 3 wherein said reflector is assymetric.

6. A lighting fixture comprising:
a main housing:
at least one cylindrical lamp holder projecting from said main housing;
a glass tube having an end cap thereon disposed over said lamp holder;
said end cap including at least one recess therein;
a reflector disposed over said glass tube and rotatably secured to said main housing;
said reflector including an end plate having at least one dimple projecting therefrom disposed thereon and adjacent said end cap; and,
a biasing means for biasing said end plate into engagement with said end cap.

7. The lighting fixture of claim 6, wherein said recesses are disposed circumferentially about said end cap.

8. The lighting fixture of claim 6 wherein said biasing means includes a fastener projecting through said end plate and received within said end cap.

9. The lighting fixture of claim 6 including means for releasably securing said end plate from the remainder of said reflector.

10. The lighting fixture of claim 6 wherein said end plate includes two dimples, each projecting from opposite sides of said end plate.

11. A lighting fixture, comprising;
a main housing having a lamp holder projecting therefrom;
a tubular support having opposed first and second ends, said first end slidingly engaged over said lamp holder;
a receiving plate mounted to said tubular support second end;
said receiving plate having an outer surface projecting opposite said tubular support and having recesses therein;
a reflector having an integral pressure plate thereon and mounted over said tubular support and said lamp holder;
said pressure plate including a dimple projecting therefrom; and
an attachment for selectively placing said pressure plate against said receiving plate and said dimple into engagement with one of said recesses.

12. The lighting fixture of claim 11, wherein said receiving plate is generally cylindrical and said recesses are equally circumferentially spaced thereon.

13. The lighting fixture of claim 12, wherein said receiving plate includes a threaded hole therein;
said pressure plate includes a through hole therein; and
said attachment means is a threaded fastener having a head portion larger than said through hole and a threaded portion threadingly engaged in said threaded hole, whereby said fastener may be loosened to permit rotational movement of said pressure plate relative said receiving plate to modify the orientation of said reflector.

14. The lighting fixture of claim 11, wherein said reflector has an asymmetric profile.

15. The lighting fixture of claim 11, wherein said tubular support is a glass tube.

16. A lighting fixture, comprising;
a main housing having first and second lamp holders projecting therefrom;
a tubular support mounted over each of said lamp holders and projecting outward from said main housing;
a receiving plate mounted over said lamp supports opposite said main housing;
an asymmetric reversible reflector mounted over said lamp support and lamp holder;
said reflector including opposed first and second ends, a spring releasably attached to one of said ends, and a pressure plate having dimples projecting from opposed first and second faces thereof and mounted to the other end of said reflector;
said reflector mounted over said first lamp support having said second end disposed adjacent said main housing and said pressure plate mounted to said first opposed end thereof such that said dimple on said first face engages said receiving plate; and
said reflector mounted over said second lamp support having said first end disposed adjacent said main housing and said pressure plate mounted to said second opposed end thereof such that said dimple on said second face engages said receiving plate.

* * * * *

UNITED STATES PATENT AND TRADEMARK OFFICE

CERTIFICATE OF CORRECTION

PATENT NO. : 4,924,365

DATED : May 8, 1990

INVENTOR(S) : Andris Bogdanovs

It is certified that error appears in the above—identified patent and that said Letters Patent is hereby corrected as shown below:

Column 4, line 11; after "attachment" insert -means-.

Signed and Sealed this

Seventeenth Day of March, 1992

*Attest:*

HARRY F. MANBECK, JR.

*Attesting Officer*

*Commissioner of Patents and Trademarks*